US007244197B1

(12) United States Patent
Kucek

(10) Patent No.: US 7,244,197 B1
(45) Date of Patent: Jul. 17, 2007

(54) BASEBALL PITCHING TRAINING DEVICE

(76) Inventor: Jack Kucek, 8220 Blue Heron Dr., Canfield, OH (US) 44406

( * ) Notice: Subject to any disclaimer, the term of this patent is extended or adjusted under 35 U.S.C. 154(b) by 15 days.

(21) Appl. No.: 11/166,814

(22) Filed: Jun. 27, 2005

(51) Int. Cl.
*A63B 69/00* (2006.01)
*A41D 19/00* (2006.01)

(52) U.S. Cl. ..... 473/458; 473/464; 2/161.1; 2/19

(58) Field of Classification Search ..... 473/422, 473/450, 458, 464, 451, 205, 212, 59; 2/16, 2/19–21, 159, 161.1
See application file for complete search history.

(56) References Cited

U.S. PATENT DOCUMENTS

| | | | | | |
|---|---|---|---|---|---|
| 1,819,048 | A | * | 8/1931 | Till | 2/19 |
| 2,725,561 | A | * | 12/1955 | Blepp | 2/19 |
| 3,152,337 | A | * | 10/1964 | Barry | 2/159 |
| 3,997,159 | A | | 12/1976 | Malhas | |
| 4,121,824 | A | * | 10/1978 | Hirschfield | 473/458 |
| 4,253,664 | A | | 3/1981 | Daulton | |
| 4,753,442 | A | | 6/1988 | Bland | |
| 5,346,208 | A | * | 9/1994 | Wood, Sr. | 473/464 |
| 5,414,868 | A | * | 5/1995 | Crawford | 2/160 |
| 5,687,421 | A | * | 11/1997 | Murai | 2/19 |
| 5,758,805 | A | * | 6/1998 | Dunn | 223/78 |
| 5,876,292 | A | | 3/1999 | Hamilton | |
| 6,006,358 | A | * | 12/1999 | Keating | 2/161.1 |
| 6,941,578 | B2 | * | 9/2005 | Anderson | 2/19 |
| 2003/0211905 | A1 | | 11/2003 | Miller | |
| 2004/0018899 | A1 | * | 1/2004 | Thiruppathi | 473/464 |

* cited by examiner

*Primary Examiner*—Mitra Aryanpour
(74) *Attorney, Agent, or Firm*—Harpman & Harpman

(57) ABSTRACT

A device and method of use in learning, practicing and perfecting a baseball pitching motion comprising, a practice glove worn on the pitching hand having a pair of directional indicator elements extending therefrom. The indicator elements extending as independent elongated flexible band ribbons attached to the end of the index finger portion and adjacent finger portion. By practicing the pitching motion, the relative position of the indicator strap ribbons will confirm and teach proper pitching arm and hand position through the multiple pitching sequence of the pitching action.

1 Claim, 6 Drawing Sheets

BASEBALL PITCHING TRAINING DEVICE

BACKGROUND OF THE INVENTION

1. Technical Field

This device and method relates to the teaching of proper baseball pitching techniques to improve the pitching mechanics of the pitcher.

2. Description of Prior Art

Prior art devices of this type are unknown for baseball pitching. A variety of sports related devices have been developed to teach proper sports form and mechanics, see for example U.S. Pat. No. 3,997,159 on a tennis training device that has a weighted flexible tether that is grasped at one end and swung forward using the motion associated with the exaggerated throwing of a baseball to teach the proper arm stroke used in tennis.

U.S. Pat. No. 4,253,664 discloses another tennis training device that uses a pair of weighted elongated pouches attached to a handle at one end.

A baseball glove with an automatic ball return device is claimed in U.S. Pat. No. 4,753,442 that is used with a baseball glove and has a baseball attached to the end of a flexible line. The other end of the line extends from a retractable spool positioned on the backside of a baseball glove.

In U.S. Pat. No. 5,876,292 a golf training aid is disclosed using a clicker which is slidably positioned on an extension element from the golfer's wrist.

Finally, in U.S. Patent Publication US 2003/0210905 A1 a dual purpose child's baseball glove is disclosed having a baseball secured to the end of the resilient tether extending from the ball and attached on the other end to the glove.

SUMMARY OF THE INVENTION

A baseball method and teaching device for pitching in which a specialized sports glove is used by the pitcher to simulate the action of pitching a baseball. The glove has positioning indicator strips extending from its fingers to provide for a visual indicator of the pitching arm and hand position during the act of pitching. By following a set of method steps the correct arm and hand action position can be taught and confirmed by the resulting positioning of the indicator strips in relation to the pitcher's body.

DETAILED DESCRIPTION OF THE INVENTION

Figure 6:
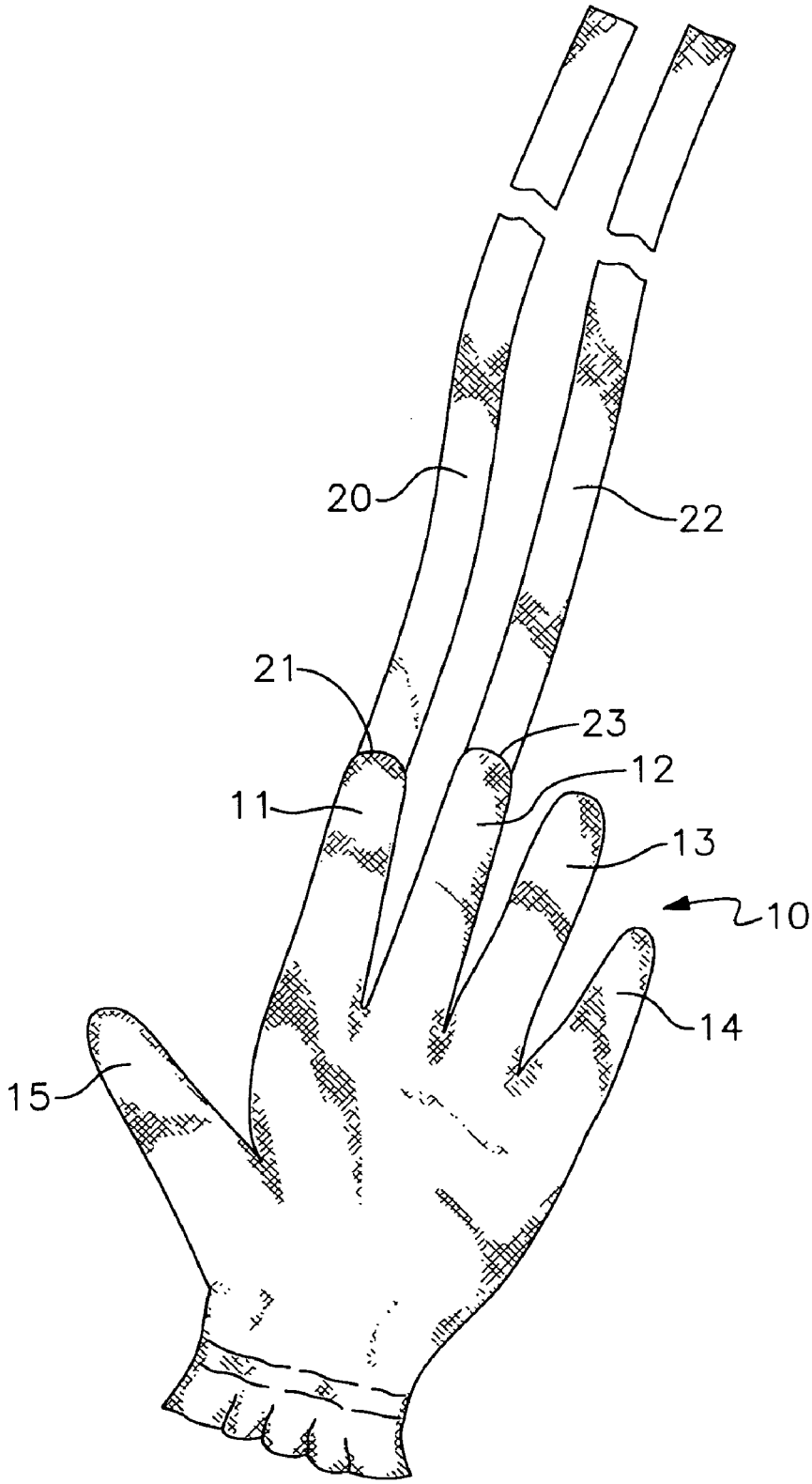
FIG. 6 is an enlarged perspective view of the training glove of the invention.

Referring now to FIG. 6 of the drawings, a training glove 10 of the invention for teaching baseball pitching can be seen. The glove 10 has a plurality of finger portions 11, 12, 13 and 14 with an adjacent thumb portion 15 and a backhand portion 16. A palm portion 17 interconnects the hereinbefore described finger and thumb portions with a preferably integral elastic wrist band insert 18 inwardly of the glove's open end at 19.

A finger portion 11 defined as the "index finger" has a position indicator band 20 of the invention secured to an end tip portion 21. The indicator band 20 is of an elongated flat flexible synthetic fabric material of extended length as will be described in greater detail hereinafter. The indicator band 20 is of a transverse dimension equal to that of the finger portion 11 from which it extends and is flexible, as noted, due to its extended length and the properties of the material from which it is made.

A second indicator band 22 is attached to and extend from an end tip 23 of the finger portion 12 adjacent that of the first "index" finger portion 11. The second indicator band 22 is of the same material and dimensional characteristics as of the first indicator band 20 as hereinbefore described.

Referring now to FIGS. 1-5 of the drawings, a training practice sequence is illustrated illustrating and detailing the critical steps and positions of the motions of a correct pitch using the training glove 10 of the invention by a player P.

Figure 1:
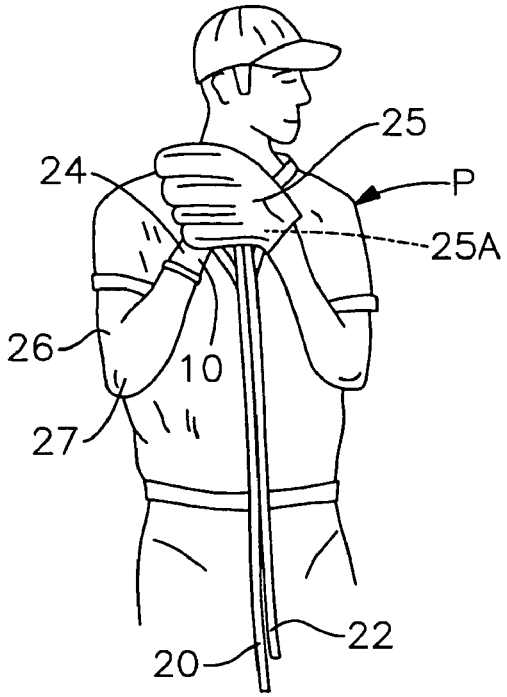
FIG. 1 is a perspective view illustrating the first indication position of the pitcher with the training glove of the invention.

In FIG. 1 of the drawings, a first position is illustrated as a hands together relaxed position with a pitching hand 24 is resting inside a baseball glove 25 on the glove hand 25A. The indicator bands 20 and 22 hang straight down along the center axis of the player's body B. The indicator bands 20 and 22 do not move which indicates and creates the proper balance that is needed on the rubber of a pitching mound (not shown).

Figure 2:
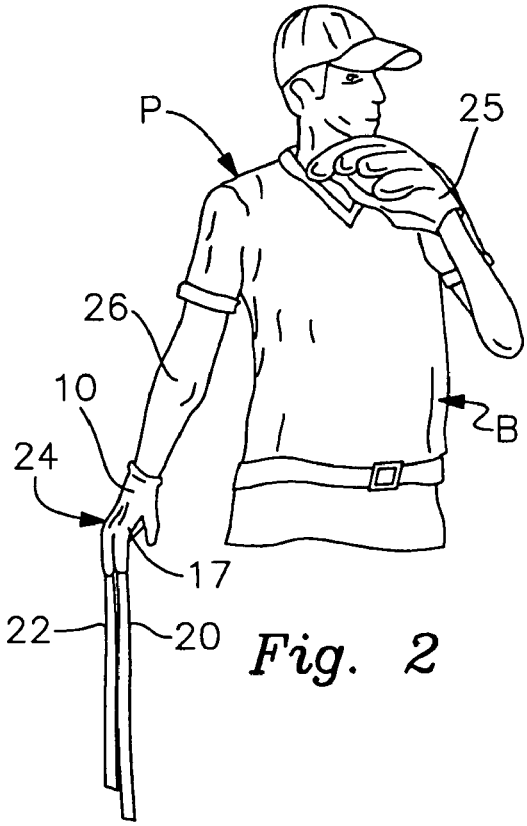
FIG. 2 is a perspective view illustrating the second indication position of a pitcher with the training glove.

FIG. 2 defines the "thumbs to thigh" position in which the indicator bands 20 and 22 will hang straight down from the pitching hand 24 with the palm portion 17 of the pitching hand 24 facing to the first base side of the field (not shown).

Figure 3:
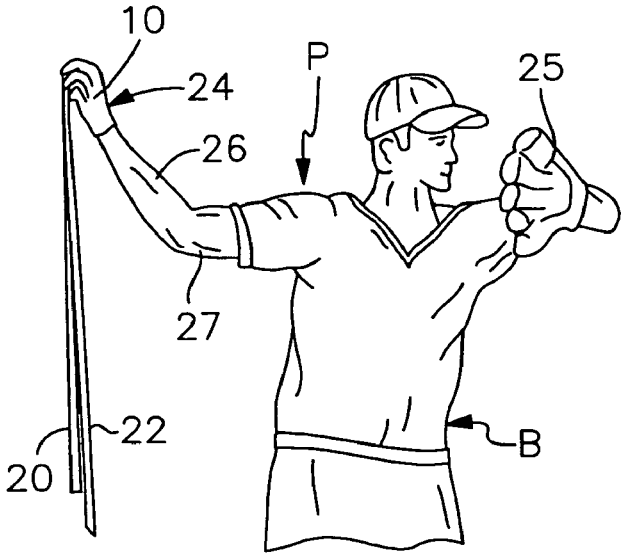
FIG. 3 is a perspective view of the third indicator position.

In FIG. 3 of the drawings, the pitching position step is illustrated of "knuckles high, gloves to the sky" in which the proper pitching arm 26 and pitching hand 24 position with the training glove 10 thereon is achieved wherein the indicator bands 20 and 22 will hang straight down with an elbow 27 bent so that the indicator bands 20 and 22 are approximately one to four inches in spaced relation from the elbow 27. This correct position, thus indicated by arrows, will allow the pitcher P to rotate his pitching hand 24 at the proper position to lessen the chances of arm injury. If, for example, the indicator bands 20 and 22 land over the pitcher's arms 26 bicep portion (not shown) the pitcher P in such position may cause injury.

Alternately, if the indicator bands 20 and 22 are not within the afore defined distance from the elbow portion 27 as illustrated by arrows, the pitching arm 26 would be improperly straight (not shown) thus causing the elbow 27 to drop below the shoulder causing increased strain on the pitcher's shoulder causing potential injury.

Figure 4:
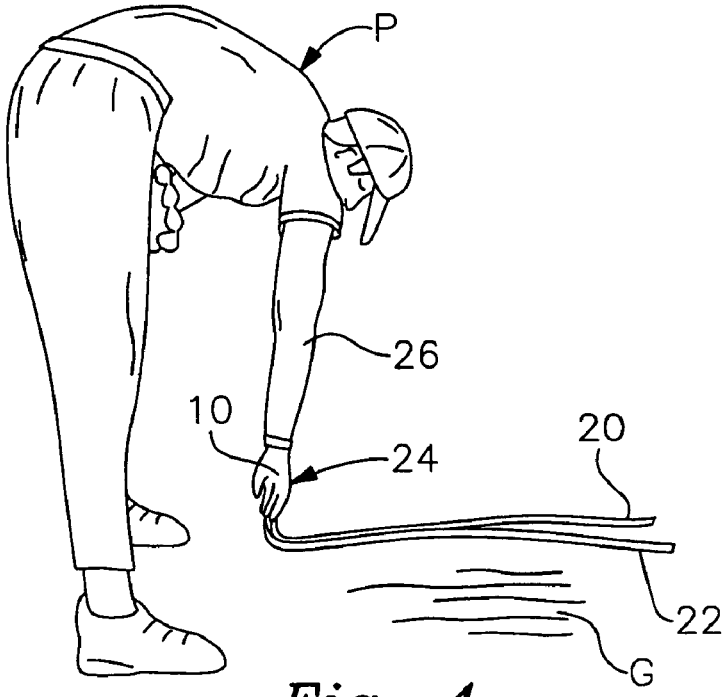
FIG. 4 is a perspective view of the fourth indicator position.

Referring now to FIG. 4 of the drawings, the arm motion of the pitch has simulated an indication of ball release and wherein the indicator bands 20 and 22 will engage "slap" the ground G forward of the pitcher with the "nose to toes, with eyes to the sky" position. The indicator bands 20 and 22 are now extended outwardly from the training glove 10 and on the ground G making a distinct slapping sound if proper positioning has been achieved at this functional point in the pitching motion.

Figure 5:
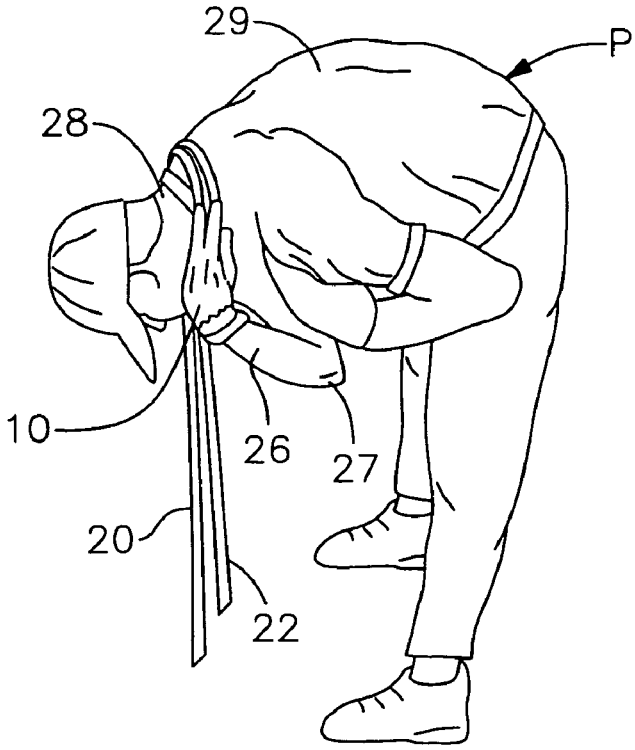
FIG. 5 is a perspective view of the fifth indicator position.

Referring now to FIG. 5 of the drawings, the proper follow-through is illustrated in which the indicator bands 20 and 22 must wrap somewhere around the pitcher P's neck 28 as shown or upper back 29 to indicate proper follow-through has been achieved. If, for example, the indicator bands 20 and 22 do not stay on the neck 28 or the back 29 then the pitcher's arm 26 will whip back to the ground as in a so-called "bull whipping" known within the art causing potential arm injury.

Referring now to FIGS. 7-10 of the drawings, an alternate glove hand and pitching arm positions of the training glove 10's indicator bands 20 and 22 are illustrated for softball pitching motion in which the pitching arm 26 position and action are different from the underhand throwing style of fast pitch softball.

Figure 7:
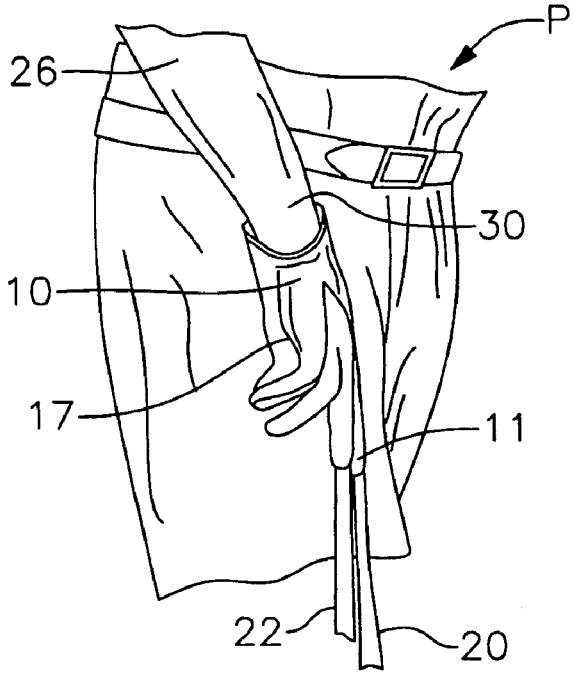
FIG. 7 is a perspective view of an alternate pitching method for softball pitching with the training glove illustrating the first indicator position of a pitcher.

In FIG. 7 of the drawings specifically a hand relaxed position is shown with the arm 26 extended downwardly and accordingly the indicator bands 20 and 22 hanging straight down from the training glove 10 of the invention.

Figure 8:
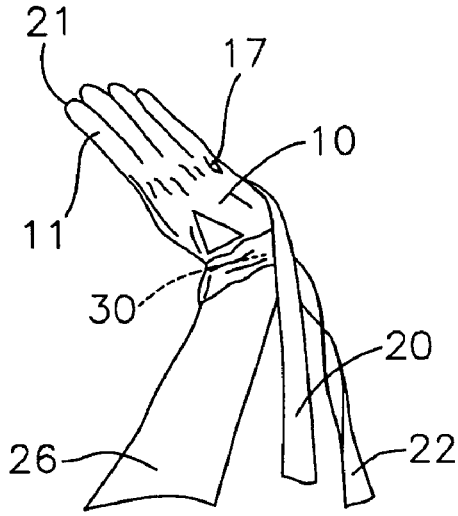
FIG. 8 is a perspective view of the pitching method for softball illustrating the second indicator position of a pitcher with the training glove.

In FIG. 8 of the drawings, the illustrated portion of the softball pitch mechanics is illustrated as the pitching hand 24 swings forward with the wrist 30 caulked backwards. The indicator bands 20 and 22 will then lie across if properly done the palm portion 17 with the remaining sections of the bands hanging straight down. This "setting" of the wrist is a position in which the hand is snapped forward upon release during the pitching action.

Figure 9:
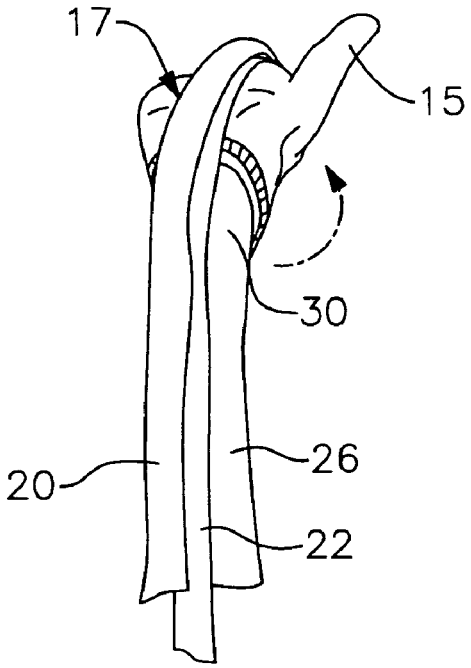
FIG. 9 is a perspective view of the pitching method for softball illustrating the third indicator position of a pitcher with the training glove.

Referring now to FIG. 9 of the drawings, an illustration of the hand 24 rotation towards the third base of a playing field (not shown) for right hand pitchers keeping the wrist 30 caulked back so that the indicator bands 20 and 22 lay across the palm 17 of the hand 24 and hang straight down thus setting the wrist 30 in position to "snap" forward upon release during the pitching action.

Figure 10:
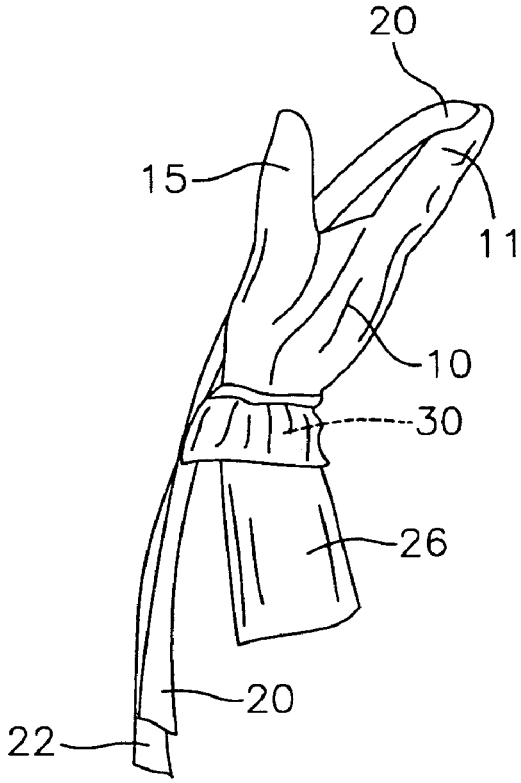
FIG. 10 is a perspective view of an alternate pitching method for softball pitching illustrating the fourth indicator position of a pitcher with the training glove.

Referring now to FIG. 10 of the drawings, the pitcher's hand 24 is shown as rotating back towards the second base of the baseball field (not shown) again keeping the wrist caulked back with the indicator bands 20 and 22 laying thereacross and hanging straight down. This keeps the wrist in position to "snap" forward.

Figure 11:
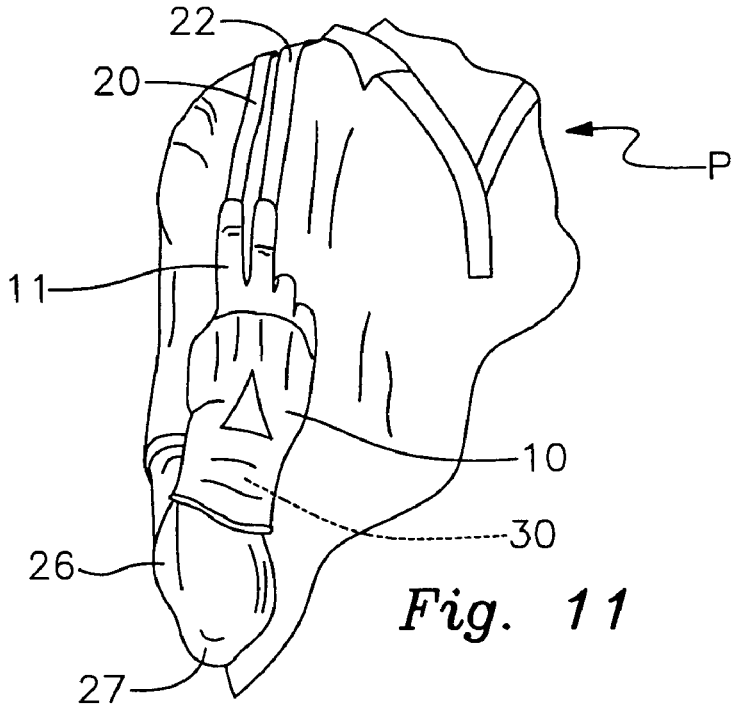
FIG. 11 is a perspective view of an alternate pitching method for softball pitching illustrating the fifth indicator position of a pitcher with the training glove.

For a fast ball pitch as seen in FIG. 11 of the drawings illustrating the arm 26 rotating to throw the ball with the wrist 30 "snaps" forward with the indicator bands 20 and 22 flying over and landing on the shoulder 32 of the player P ensuring proper fastball technique which will be evident to those skilled in the art.

Figure 12:
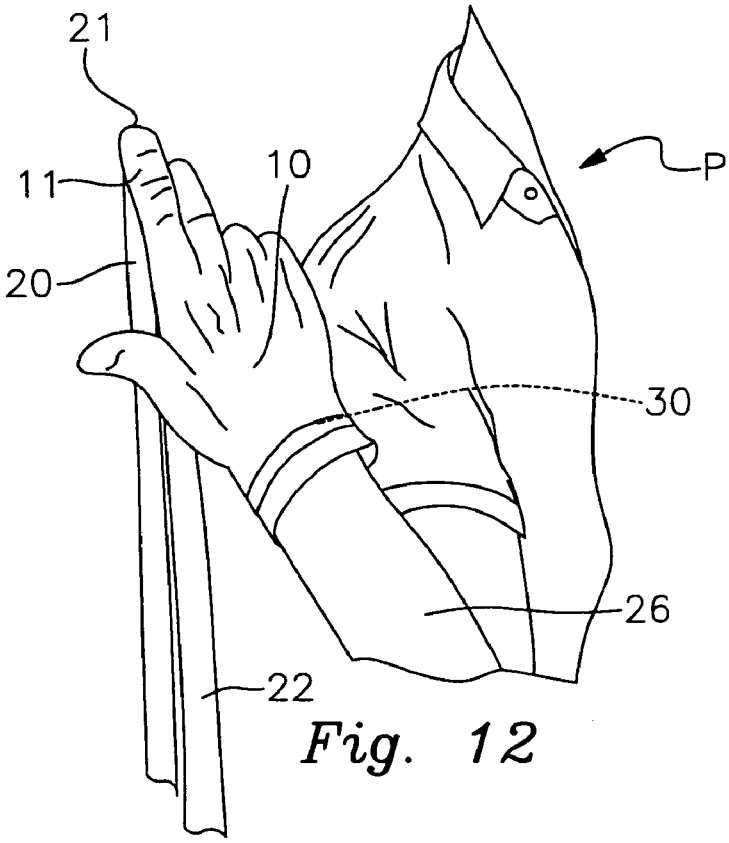
FIG. 12 is a perspective view of an alternate pitching method for softball pitching illustrating the sixth indicator position of a pitcher with the training glove.

In FIG. 12 of the drawings, the proper positions of the indicator bands 20 and 22 are shown for throwing a "rise ball". The pitching arm 26 rotates to throw the ball to the plate (not shown) with the wrist 30 now "snaps" forward with the indicator bands 20 and 22 flying away. The indicator bands 20 and 22 must fly forward towards first base or third base of a playing field (not shown) depending on a right hand or left hand pitcher away from the throwing shoulder. This position of the indicator bands 20 and 22 will indicate a proper "rise ball" technique has been followed.

Figure 13:
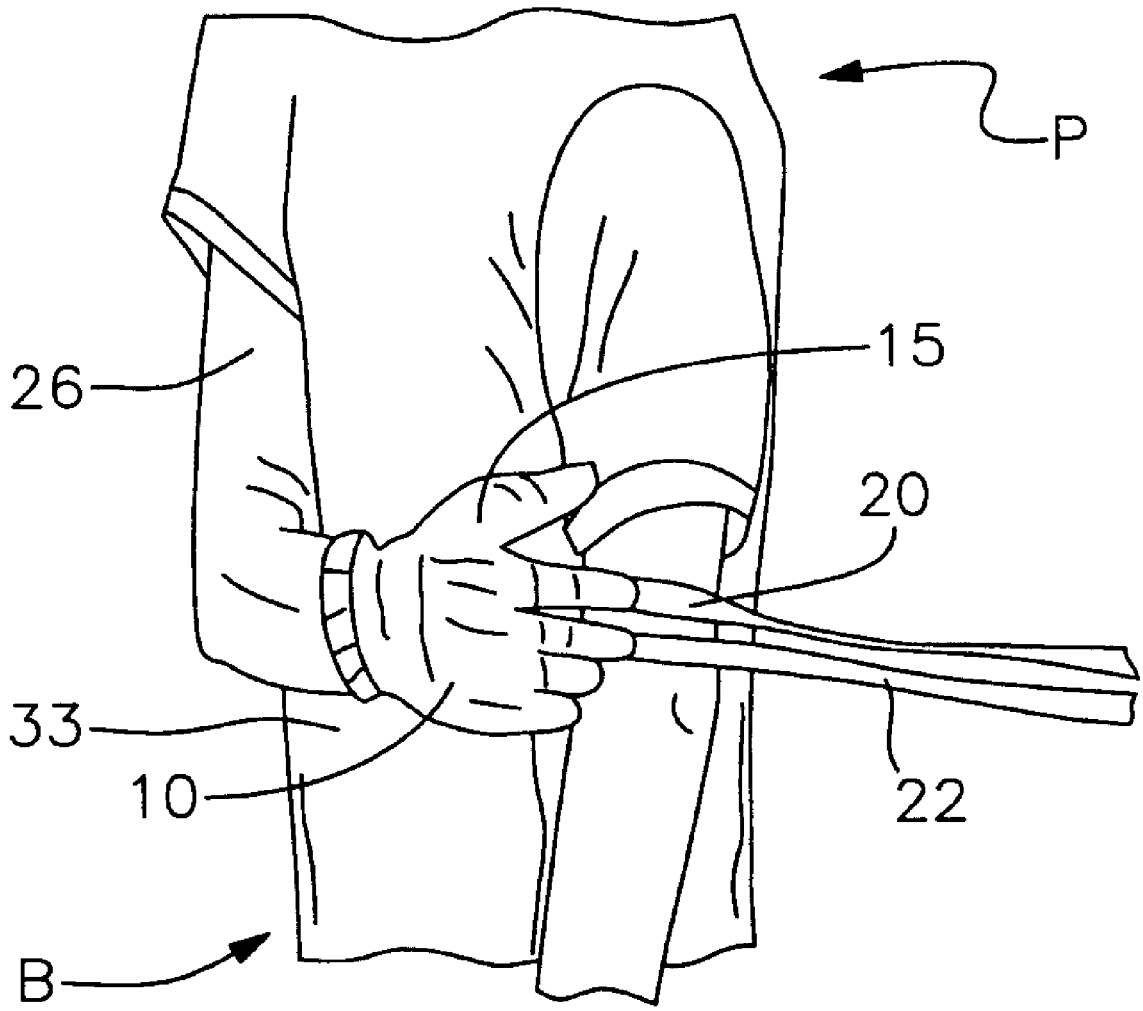
FIG. 13 is a perspective view of an alternate pitching method for softball pitching illustrating the seventh indicator position of a pitcher with the training glove.

Finally, in FIG. 13 of the drawings, a proper "curve" ball technique is illustrated for underhand softball pitching so as the pitching arm 26 rotates the wrist 30 now "snaps" forward with the result that the indicator bands 20 and 22 of the invention fly across the pitcher's body B. Specifically, the indicator bands 20 and 22 must fly towards first base or third base of the field (not shown) as noted above and across the pitcher's stomach 33.

It will be seen from the above description and illustrations that by use of the training glove 10 and the integral indicator bands 20 and 22 of the invention, a visual indication system of proper baseball pitching technique has been disclosed. By determining the relative positions of the indicator bands 20 and 22, the proper mechanics of pitching can be taught for both hard and softball pitchers.

Thus it will be seen that a new and novel training glove for pitchers has been illustrated and described and it will be apparent to those skilled in the art that various changes and modifications may be made therein without departing from the spirit of the invention.

Therefore I claim:

1. A baseball training glove and method of teaching proper pitching techniques said training glove comprises, a glove body having multiple finger portions and a thumb receiving portion, independent elongated flexible band elements extending respectively from respective free ends of an index finger portion and an adjacent finger portion to hang freely from said baseball training glove when simulating a pitching action, said index and adjacent finger portions are of a known transverse dimension and said respective band elements are of an equal transverse dimension to said index and adjacent finger portions and are of a length greater than that of the overall longitudinal dimension of said training glove, said method of teaching proper pitching techniques comprising the steps of, a. bring hands together chest high with band elements stationary hanging vertically therefrom, b. pitching arm and hands of a pitcher extending straight downwardly with band elements hanging therefrom with thumb receiving portion towards a pitcher's thigh and a glove palm portion facing to a first base side of a baseball field, c. raising said pitching arm and hand upwardly, and band elements hanging vertically from the gloved pitching hand, d. raising said pitching arm upwardly, an elbow bent, and said palm portion facing towards second base with band elements hanging vertically in spaced relation to said elbow, e. band elements enaging the ground in front of said pitcher with portions of the pitching arm extending downwardly, f. band elements wrapped around the pitcher's back and neck and hanging down with the pitching arm extending around the pitcher's body for follow through.

* * * * *